US010730319B2

(12) United States Patent
Nishimura et al.

(10) Patent No.: US 10,730,319 B2
(45) Date of Patent: Aug. 4, 2020

(54) DRYING DEVICE, LIQUID DISCHARGE APPARATUS, AND DRYING METHOD

(71) Applicants: Hideaki Nishimura, Kanagawa (JP); Yoshiaki Hoshino, Kanagawa (JP); Hirokazu Ikenoue, Tokyo (JP); Yoshiki Yanagawa, Telford England (GB); Amika Sagara, Kanagawa (JP)

(72) Inventors: Hideaki Nishimura, Kanagawa (JP); Yoshiaki Hoshino, Kanagawa (JP); Hirokazu Ikenoue, Tokyo (JP); Yoshiki Yanagawa, Telford England (GB); Amika Sagara, Kanagawa (JP)

(73) Assignee: Ricoh Company, Ltd., Tokyp (JP)

( * ) Notice: Subject to any disclaimer, the term of this patent is extended or adjusted under 35 U.S.C. 154(b) by 0 days.

(21) Appl. No.: 16/356,522

(22) Filed: Mar. 18, 2019

(65) Prior Publication Data

US 2019/0283463 A1 Sep. 19, 2019

(30) Foreign Application Priority Data

Mar. 19, 2018 (JP) ..... 2018-050417
Jan. 25, 2019 (JP) ..... 2019-011210

(51) Int. Cl.

| | |
|---|---|
| ***B41J 11/00*** | (2006.01) |
| ***B41M 7/00*** | (2006.01) |
| ***B41J 2/01*** | (2006.01) |
| ***B41J 29/38*** | (2006.01) |

(52) U.S. Cl.

CPC ..... *B41J 11/002* (2013.01); *B41J 2/01* (2013.01); *B41M 7/009* (2013.01); *B41J 29/38* (2013.01)

(58) Field of Classification Search

CPC . B41J 11/002; B41J 2/01; B41J 29/38; B41M 7/009

USPC ..... 347/102

See application file for complete search history.

(56) References Cited

U.S. PATENT DOCUMENTS

| | | | | |
|---|---|---|---|---|
| 8,807,736 | B1 * | 8/2014 | Walker | B41J 11/002 347/102 |
| 2009/0197093 | A1 * | 8/2009 | Kofuji | B41J 2/175 428/423.1 |
| 2013/0021412 | A1 | 1/2013 | Nishimura et al. | |
| 2013/0070021 | A1 | 3/2013 | Nishimura et al. | |
| 2013/0215188 | A1 | 8/2013 | Nishimura et al. | |
| 2014/0028756 | A1 | 1/2014 | Nishimura et al. | |
| 2014/0375737 | A1 * | 12/2014 | Van Beek | B41J 11/002 347/102 |
| 2015/0174924 | A1 | 6/2015 | Fuchioka et al. | |
| 2016/0101635 | A1 | 4/2016 | Hoshino et al. | |
| 2017/0121543 | A1 | 5/2017 | Sakaguchi et al. | |

(Continued)

FOREIGN PATENT DOCUMENTS

| | | |
|---|---|---|
| JP | 2013-029268 | 2/2013 |
| JP | 2013-166258 | 8/2013 |
| JP | 2016-168805 | 9/2016 |

*Primary Examiner* — Huan H Tran
*Assistant Examiner* — Alexander D Shenderov
(74) *Attorney, Agent, or Firm* — Duft & Bornsen, PC

(57) ABSTRACT

A drying device includes a drier, a gas circulator, and a concentration adjuster. The drier warms a liquid composition on a drying target object. The gas circulator circulates a gas containing a volatile component of an organic solvent warmed and volatilized by the drier to reuse the gas for drying. The concentration adjuster adjusts a concentration of the volatile component reused.

16 Claims, 8 Drawing Sheets

(56) References Cited

U.S. PATENT DOCUMENTS

| | | | | |
|---|---|---|---|---|
| 2017/0130081 | A1 | 5/2017 | Toyama et al. | |
| 2017/0173974 | A1 | 6/2017 | Hoshino et al. | |
| 2017/0266991 | A1 | 9/2017 | Onodera et al. | |
| 2017/0361632 | A1 | 12/2017 | Toyama et al. | |
| 2018/0141348 | A1 | 5/2018 | Hoshino et al. | |
| 2018/0222178 | A1* | 8/2018 | Boland | F26B 21/004 |
| 2018/0244935 | A1 | 8/2018 | Sakaguchi et al. | |
| 2018/0264803 | A1* | 9/2018 | Hoshino | B41F 23/0426 |

* cited by examiner

DRYING DEVICE, LIQUID DISCHARGE APPARATUS, AND DRYING METHOD

CROSS-REFERENCE TO RELATED APPLICATIONS

This patent application is based on and claims priority pursuant to 35 U.S.C. § 119(a) to Japanese Patent Application Nos. 2018-050417, filed on Mar. 19, 2018, and 2019-011210, filed on Jan. 25, 2019 in the Japan Patent Office, the entire disclosure of each of which is incorporated by reference herein.

BACKGROUND

Technical Field

Aspects of the present disclosure relate to a drying device, a liquid discharge apparatus, and a drying method.

Related Art

As a printing apparatus for applying a liquid to a heating target object such as roll paper, a continuous sheet, a web, or a sheet, there is an apparatus including a drying device to promote drying of the applied liquid.

SUMMARY

In an aspect of the present disclosure, there is provided a drying device that includes a drier, a gas circulator, and a concentration adjuster. The drier warms a liquid composition on a drying target object. The gas circulator circulates a gas containing a volatile component of an organic solvent warmed and volatilized by the drier to reuse the gas for drying. The concentration adjuster adjusts a concentration of the volatile component reused.

In another aspect of the present disclosure, there is provided a liquid discharge apparatus that includes a liquid applicator to apply a liquid to a member to be conveyed and the drying device.

In still another aspect of the present disclosure, there is provided a drying method that includes warming a liquid composition on a drying target object, circulating a gas containing a volatile component of an organic solvent volatilized by the warming to reuse the gas for drying, and adjusting a concentration of the volatile component reused.

BRIEF DESCRIPTION OF THE DRAWINGS

The aforementioned and other aspects, features, and advantages of the present disclosure would be better understood by reference to the following detailed description when considered in connection with the accompanying drawings, wherein.

DETAILED DESCRIPTION

Figure 1:
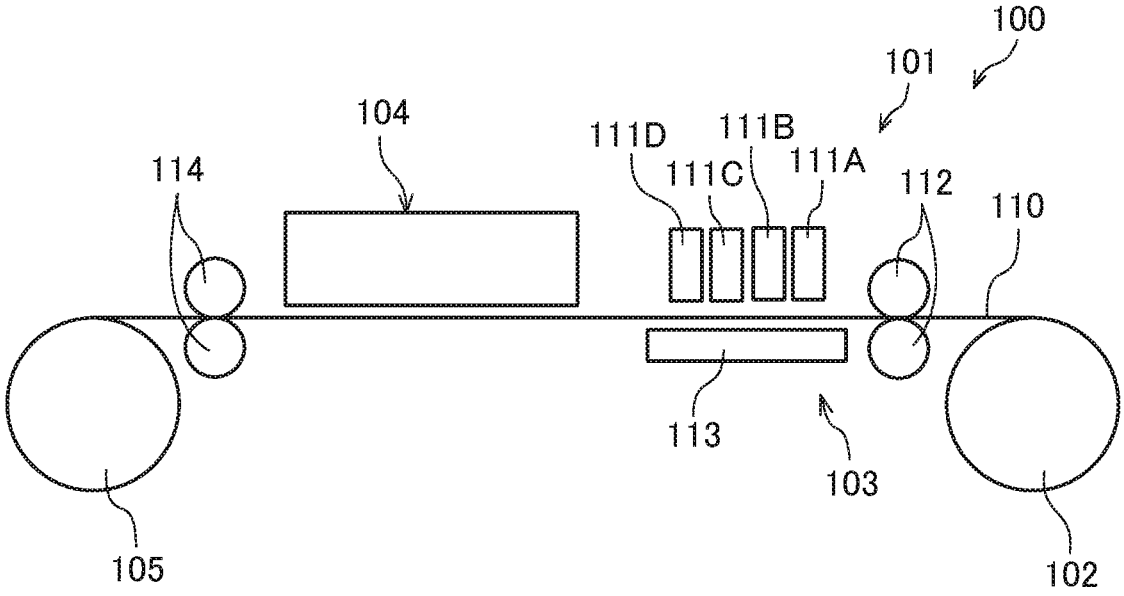
FIG. 1 is a schematic explanatory view of an example of a printing apparatus as a liquid discharge apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and 5 achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, embodiments of the present disclosure will be described referring to the attached drawings. A first embodiment of the present disclosure will be described referring to FIG. 1. FIG. 1 is a schematic explanatory view of an example of a printing apparatus as a liquid discharge apparatus according to the first embodiment.

A printing apparatus 100 is an inkjet recording apparatus and includes a liquid application device 101 including liquid discharge heads 111 (111A to 111D) as a liquid applicator for discharging and applying an ink which is a liquid of a required color to a continuous sheet 110 which is a member to be conveyed (a member to be conveyed, a heating target object, and a drying target object).

For example, the liquid application device 101 has full line type liquid discharge heads 111 for four colors arranged from a conveyance direction upstream side of the continuous sheet 110, and applies liquids of black K, cyan C, magenta M, and yellow Y to the continuous sheet 110. The types and the number of colors are not limited thereto.

The continuous sheet 110 is fed out from an unwinding roller 102 and delivered onto a conveying guide member 113 disposed facing the liquid application device 101 by a conveying roller 112 of a conveyor 103, guided by the conveying guide member 113, and conveyed (moved) facing the liquid application device 101.

The continuous sheet 110 to which a liquid has been applied by the liquid application device 101 passes through a drying device (drying unit) 104 according to an embodiment of the present disclosure, is sent by a discharge roller 114, and wound by a winding roller 105.

An organic solvent, water, a coloring material, a resin, an additive, and the like of a liquid (ink) used by the printing apparatus 1 will be described.

<Organic Solvent>

The organic solvent to be used is not particularly limited, and a water-soluble organic solvent can be used. Examples thereof include a polyhydric alcohol, an ether such as a polyhydric alcohol alkyl ether or a polyhydric alcohol aryl ether, a nitrogen-containing heterocyclic compound, an amide, an amine, and a sulfur-containing compound.

Specific examples of the water-soluble organic solvent include: a polyhydric alcohol such as ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, or petriol; a polyhydric alcohol alkyl ether such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, or propylene glycol monoethyl ether; a polyhydric alcohol aryl ether such as ethylene glycol monophenyl ether or ethylene glycol monobenzyl ether; a nitrogen-containing heterocyclic compound such as 2-pyrrolidone, N-methyl-2-pyrrolidone, N-hydroxyethyl-2-pyrrolidone, 1,3-dimethyl-2-imidazolidinone, ε-caprolactam, or γ-butyrolactone; an amide such as formamide, N-methylformamide, N,N-dimethylformamide, 3-methoxy-N,N-dimethylpropionamide, or 3-butoxy-N,N-dimethylpropionamide; an amine such as monoethanolamine, diethanolamine, or triethylamine; a sulfur-containing compound such as dimethylsulfoxide, sulfolane, or thiodiethanol; propylene carbonate; and ethylene carbonate.

An organic solvent having a boiling point of 250° C. or lower is preferably used because the organic solvent not only functions as a wetting agent but also imparts a good drying property.

A polyol compound having 8 or more carbon atoms and a glycol ether compound are also suitably used. Specific examples of the polyol compound having 8 or more carbon atoms include 2-ethyl-1,3-hexanediol and 2,2,4-trimethyl-1,3-pentanediol.

Specific examples of the glycol ether compound include: a polyhydric alcohol alkyl ether such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, or propylene glycol monoethyl ether; and a polyhydric alcohol aryl ether such as ethylene glycol monophenyl ether or ethylene glycol monobenzyl ether.

The polyol compound having 8 or more carbon atoms and the glycol ether compound can improve a permeation property of the ink when paper is used as a printing medium.

The content of an organic solvent in the ink is not particularly limited and may be appropriately selected according to a purpose, but is preferably 10% by mass or more and 60% by mass or less and more preferably 20% by mass or more and 60% by mass or less from viewpoints of a drying property of the ink and discharge reliability.

<Water>

The content of water in the ink is not particularly limited and may be appropriately selected according to a purpose, but is preferably 10% by mass or more and 90% by mass or less and more preferably 20% by mass to 60% by mass from viewpoints of a drying property of the ink and discharge reliability.

<Coloring Material>

A coloring material is not particularly limited, and a pigment and a dye can be used.

As the pigment, an inorganic pigment or an organic pigment can be used. These materials may be used singly or in combination of two or more kinds of thereof. A mixed crystal may also be used.

Examples of the pigment include a black pigment, a yellow pigment, a magenta pigment, a cyan pigment, a white pigment, a green pigment, an orange pigment, a gloss color pigment such as a gold pigment or a silver pigment, and a metallic pigment.

Examples of the inorganic pigment include titanium oxide, iron oxide, calcium carbonate, barium sulfate, aluminum hydroxide, barium yellow, cadmium red, and chrome yellow, and further include carbon black manufactured by a known method such as a contact method, a furnace method, or a thermal method.

Examples of the organic pigment include an azo pigment, a polycyclic pigment (for example, a phthalocyanine pigment, a perylene pigment, a perinone pigment, an anthraquinone pigment, a quinacridone pigment, a dioxazine pigment, an indigo pigment, a thioindigo pigment, an isoindolinone pigment, or a quinophthalone pigment), a dye chelate (for example, a basic dye type chelate or an acidic dye type chelate), a nitro pigment, a nitroso pigment, and aniline black. Among these pigments, a pigment having good affinity with a solvent is preferably used. In addition, resin hollow particles and inorganic hollow particles can also be used.

Specific examples of the pigment for black include: carbon black (colour index international (C.I.) Pigment Black 7) such as furnace black, lamp black, acetylene black, or channel black; a metal such as copper, iron (C.I. Pigment Black 11), or titanium oxide; and an organic pigment such as aniline black (C.I. Pigment Black 1).

Specific examples of the pigment for colors include: C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2, and 48:2 (permanent red 2B (Ca)), 48:3, 48:4, 49:1, 52:2, 53:1, 57:1 (brilliant carmine 6B), 60:1, 63:1, 63:2, 64:1, 81, 83, 88, 101 (redness), 104, 105, 106, 108 (cadmium red), 112, 114, 122 (quinacridone magenta), 123, 146, 149, 166, 168, 170, 172, 177, 178, 179, 184, 185, 190, 193, 202, 207, 208, 209, 213, 219, 224, 254, and 264; C.I. Pigment Violet 1 (rhodamine lake), 3, 5:1, 16, 19, 23, and 38; C.I. Pigment Blue 1, 2, 15 (phthalocyanine blue) 15:1, 15:2, 15:3, 15:4 (phthalocyanine blue), 16, 17:1, 56, 60, and 63; and C.I. Pigment Green 1, 4, 7, 8, 10, 17, 18, and 36.

The dye is not particularly limited, and an acidic dye, a direct dye, a reactive dye, and a basic dye can be used, and these dyes may be used singly or in combination of two or more kinds of thereof.

Examples of the dye include: C.I. Acid Yellow 17, 23, 42, 44, 79, and 142; C.I. Acid Red 52, 80, 82, 249, 254, and 289; C.I. Acid Blue 9, 45, and 249; C.I. Acid Black 1, 2, 24, and 94; C.I. Food Black 1 and 2; C.I. Direct Yellow 1, 12, 24, 33, 50, 55, 58, 86, 132, 142, 144, and 173; C.I. Direct Red 1, 4, 9, 80, 81, 225, and 227; C.I. Direct Blue 1, 2, 15, 71, 86, 87, 98, 165, 199, and 202; C.I. Direct Black 19, 38, 51, 71, 154, 168, 171, and 195; C.I. Reactive Red 14, 32, 55, 79, and 249; and C.I. Reactive Black 3, 4, and 35.

The content of a coloring material in the ink is preferably 0.1% by mass or more and 15% by mass or less and more preferably 1% by mass or more and 10% by mass or less from viewpoints of improvement of image density, a good fixing property, and discharge stability.

Examples of a method for dispersing a pigment in the ink include a method for introducing a hydrophilic functional group into the pigment to form a self-dispersing pigment, a method for coating a surface of the pigment with a resin to disperse the pigment, and a method for dispersing the pigment using a dispersant.

Examples of the method for introducing a hydrophilic functional group into a pigment to form a self-dispersing pigment include a method for adding a functional group such as a sulfone group or a carboxyl group to a pigment (for example, carbon) to form a self-dispersing pigment that can be dispersed in water.

Examples of the method for coating a surface of the pigment with a resin to disperse the pigment include a method for making a pigment encapsulated in a microcapsule such that the pigment can be dispersed in water. This pigment can also be referred to as a resin coated pigment. In this case, the whole pigment to be incorporated in the ink does not need to be covered with the resin. Uncoated pigment and partially coated pigment may be dispersed in the ink as long as the effect of the present disclosure is not impaired.

Examples of the method for dispersing a pigment using a dispersant include a method for dispersing a pigment using a known low molecular type dispersant or a known polymer type dispersant typified by a surfactant.

As the dispersant, for example, an anionic surfactant, a cationic surfactant, an amphoteric surfactant, a nonionic surfactant, and the like can be used depending on a pigment.

RT-100 (nonionic surfactant) manufactured by Takemoto Oil & Fat Co., Ltd. and a Na naphthalenesulfonate formalin condensate can also be suitably used as a dispersant.

The dispersants may be used singly or in combination of two or more kinds of thereof <Pigment Dispersion>

It is possible to obtain the ink by mixing a material such as water or an organic solvent with a coloring material. It is also possible to manufacture the ink by mixing a pigment and another material such as water or a dispersant to form a pigment dispersion, and mixing a material such as water or an organic solvent therewith.

The pigment dispersion is obtained by dispersing water, a pigment, a pigment dispersant, and, if necessary, another component, and adjusting a particle diameter. A disperser is preferably used for dispersion.

The particle diameter of a pigment in the pigment dispersion is not particularly limited. However, the maximum frequency in terms of the maximum number of particles is preferably 20 nm or more and 500 nm or less, and more preferably 20 nm or more and 150 nm or less from viewpoints of good dispersion stability of the pigment, high discharge stability, and high image quality such as image density. The particle diameter of the pigment can be measured using a particle size analyzer (Nanotrac Wave-UT151, manufactured by Microtrack Bell Co., Ltd.).

The content of a pigment in the pigment dispersion is not particularly limited and may be appropriately selected according to a purpose, but is preferably 0.1% by mass or more and 50% by mass or less and more preferably 0.1% by mass or more and 30% by mass or less from viewpoints of good discharge stability and high image density.

If necessary, the pigment dispersion is preferably degassed by filtering coarse particles with a filter, a centrifugal separator, or the like.

The particle diameter of a solid content in the ink is not particularly limited and may be appropriately selected according to a purpose. However, the maximum frequency in terms of the maximum number of particles is preferably 20 nm or more and 1000 nm or less, and more preferably 20 nm or more and 150 nm or less from viewpoints of high discharge stability and high image quality such as image density. The solid content includes resin particles, pigment particles, and the like. The particle diameter of the solid content can be measured using a particle size analyzer (Nanotrac Wave-UT151, manufactured by Microtrack Bell Co., Ltd.).

<Additive>

The ink may contain a surfactant, an antifoaming agent, an antiseptic and antifungal agent, a rust preventive agent, a pH adjusting agent, and the like, if necessary.

<Surfactant>

As the surfactant, any of a silicone-based surfactant, a fluorine-based surfactant, an amphoteric surfactant, a nonionic surfactant, and an anionic surfactant can be used.

The silicone-based surfactant is not particularly limited and may be appropriately selected according to a purpose. Among the silicone-based surfactants, a surfactant that does not decompose even at a high pH is preferable, and examples thereof include a side chain-modified polydimethylsiloxane, a both-terminal-modified polydimethylsiloxane, a single terminal-modified polydimethylsiloxane, and a side chain both-terminal-modified polydimethylsiloxane. A surfactant having a polyoxyethylene group or a polyoxyethylene polyoxypropylene group as a modification group is particularly preferable because of exhibiting a good property as an aqueous surfactant. As the silicone-based surfactant, a polyether-modified silicone-based surfactant can also be used, and examples thereof include a compound in which a polyalkylene oxide structure is introduced into a side chain of an Si moiety of dimethylsiloxane.

As the fluorine-based surfactant, for example, a perfluoroalkylsulfonic acid compound, a perfluoroalkylcarboxylic acid compound, a perfluoroalkylphosphate compound, a perfluoroalkylethylene oxide adduct, and a polyoxyalkylene ether polymer compound having a perfluoroalkyl ether group in a side chain are particularly preferable because of a low foaming property. Examples of the perfluoroalkyl sulfonic acid compound include a perfluoroalkyl sulfonic acid and a perfluoroalkyl sulfonate. Examples of the perfluoroalkyl carboxylic acid compound include a perfluoroalkyl carboxylic acid and a perfluoroalkyl carboxylate. Examples of the polyoxyalkylene ether polymer compound having a perfluoroalkyl ether group in a side chain include a sulfate of a polyoxyalkylene ether polymer having a perfluoroalkyl ether group in a side chain and a salt of a polyoxyalkylene ether polymer having a perfluoroalkyl ether group in a side chain. Examples of a counter ion of a salt in these fluorine-based surfactants include Li, Na, K, $NH_4$, $NH_3CH_2CH_2OH$, $NH_2(CH_2CH_2OH)_2$, and $NH(CH_2CH_2OH)_3$.

Examples of the amphoteric surfactant include a lauryl aminopropionate, lauryl dimethyl betaine, stearyl dimethyl betaine, and lauryl dihydroxyethyl betaine.

Examples of the nonionic surfactant include a polyoxyethylene alkyl phenyl ether, a polyoxyethylene alkyl ester, a polyoxyethylene alkylamine, a polyoxyethylene alkylamide, a polyoxyethylene propylene block polymer, a sorbitan fatty acid ester, a polyoxyethylene sorbitan fatty acid ester, and an ethylene oxide adduct of acetylene alcohol.

Examples of the anionic surfactant include a polyoxyethylene alkyl ether acetate, a dodecylbenzene sulfonate, a laurate, and a polyoxyethylene alkyl ether sulfate.

The surfactants may be used singly or in combination of two or more kinds of thereof.

The silicone-based surfactant is not particularly limited and may be appropriately selected according to a purpose. However, examples thereof include a side chain-modified polydimethylsiloxane, a both-terminal-modified polydimethylsiloxane, a single terminal-modified polydimethylsiloxane, and a side chain both-terminal-modified polydimethylsiloxane. A polyether-modified silicone-based surfactant having a polyoxyethylene group or a polyoxyethylene polyoxypropylene group as a modification group is particularly preferable because of exhibiting a good property as an aqueous surfactant.

As such a surfactant, a surfactant appropriately synthesized or a commercially available product may be used. The commercially available product is available, for example, from BYK Japan KK, Shin-Etsu Chemical Co., Ltd., Dow Corning Toray Co., Ltd., Nihon Emulsion Co., Ltd., and Kyoeisha Chemical Co. Ltd.

The polyether-modified silicone-based surfactant is not particularly limited and may be appropriately selected according to a purpose. Examples thereof include a compound in which a polyalkylene oxide structure is introduced into a side chain of an Si moiety of dimethylpolysiloxane, represented by general formula (S-1).

[Chemical Formula 1]

General Formula (S-1)

(In general formula (S-1), m, n, a, and b represent integers. R and R' each represent an alkyl group or an alkylene group.)

As the polyether-modified silicone-based surfactant, a commercially available product can be used, and examples thereof include KF-618, KF-642, and KF-643 (Shin-Etsu Chemical Co., Ltd.), EMALEX-SS-5602 and SS-1906EX (Nihon Emulsion Co., Ltd.), FZ-2105, FZ-2118, FZ-2154, FZ-2161, FZ-2162, FZ-2163, and FZ-2164 (Dow Corning Toray Co., Ltd.), BYK-33 and BYK-387 (BYK Japan KK), and TSF4440, TSF4452, and TSF4453 (Toshiba Silicone Co., Ltd.).

The fluorine-based surfactant is preferably a compound having 2 to 16 fluorine-substituted carbon atoms, and more preferably a compound having 4 to 16 fluorine-substituted carbon atoms.

Examples of the fluorine-based surfactant include a perfluoroalkyl phosphate compound, a perfluoroalkylethylene oxide adduct, and a polyoxyalkylene ether polymer compound having a perfluoroalkyl ether group in a side chain. Among these compounds, a polyoxyalkylene ether polymer compound having a perfluoroalkyl ether group in a side chain is preferable because of a low foaming property, and fluorine-based surfactants represented by general formulas (F-1) and (F-2) are particularly preferable.

[Chemical Formula 2]

General Formula (F-1)

In the compound represented by the above general formula (F-1), m is preferably an integer of 0 to 10, and n is preferably an integer of 0 to 40 in order to impart water solubility.

[Chemical Formula 3]

General Formula (F-2)

In the compound represented by the above general formula (F-2), Y is H, $C_nF_{2n+1}$ in which n is an integer of 1 to 6, $CH_2CH(OH)CH_2—C_nF_{2n+1}$ in which n is an integer of 4 to 6, or $C_pH_{2p+1}$ in which p is an integer from 1 to 19. a is an integer of 4 to 14.

The fluorine-based surfactant may be a commercially available product.

Examples of the commercially available product include Surflon S-111, S-112, S-113, S-121, S-131, S-132, S-141, and S-145 (manufactured by AGC Inc.); Fluoride FC-93, FC-95, FC-98, FC-129, FC-135, FC-170C, FC-430, and FC-431 (manufactured by Sumitomo 3M); Megafac F-470, F-1405, and F-474(manufactured by DIC Corporation); Zonyl TBS, FSP, FSA, FSN-100, FSN, FSO-100, FSO, FS-300, and UR (manufactured by DuPont), FT-110, FT-250, FT-251, FT-400S, FT-150, and FT-400SW (manufactured by Neos Company Limited); PolyFox PF-136A, PF-156A, PF-151N, PF-154, and PF-159 (manufactured by Omnova); and Unidyne DSN-403N (manufactured by Daikin Industries, Ltd.). Among these products, FS-300 manufactured by DuPont, FT-110, FT-250, FT-251, FT-400S, FT-150, and FT-400SW manufactured by Neos Company Limited, Polyfox PF-151N manufactured by Omnova, and Unidyne DSN-403N manufactured by Daikin Industries, Ltd. are particularly preferable from a viewpoint of good letter printing quality, particularly remarkable improvement of a permeation property, a wetting property, and a uniformly dyeing property with respect to paper.

The content of a surfactant in the ink is not particularly limited and may be appropriately selected according to a purpose, but is preferably 0.001% by mass or more and 5% by mass or less and more preferably 0.05% by mass or more and 5% by mass or less from viewpoints of an excellent wetting property, excellent discharge stability and improvement of image quality.

<Antifoaming Agent>

The antifoaming agent is not particularly limited, and examples thereof include a silicone-based antifoaming agent, a polyether-based antifoaming agent, and a fatty acid ester-based antifoaming agent. These antifoaming agents may be used singly or in combination of two or more kinds of thereof. Among these antifoaming agents, a silicone-based antifoaming agent is preferable from a viewpoint of excellent foam breaking effect.

<Antiseptic and Antifungal Agent>

The antiseptic and antifungal agent is not particularly limited, and examples thereof include 1,2-benzisothiazolin-3-one.

<Rust Preventive Agent>

The rust preventive agent is not particularly limited, and examples thereof include an acidic sulfite and sodium thiosulfate.

<pH Adjusting Agent>

The pH adjusting agent is not particularly limited as long as the pH can be adjusted to 7 or more, and examples thereof include an amine such as diethanolamine or triethanolamine.

The physical properties of the ink are not particularly limited and can be appropriately selected according to a purpose. For example, viscosity, surface tension, pH, and the like are preferably within the following ranges.

The viscosity of the ink at 25° C. is preferably 5 mPa·s or more and 30 mPa·s or less, and more preferably 5 mPa·s or more and 25 mPa·s or less from viewpoints of improving letter printing density and letter quality and obtaining a good discharge property. Here, for example, a rotational viscometer (RE-80L manufactured by Toki Sangyo Co., Ltd.) can be used in order to measure the viscosity. Measurement can be performed under measurement conditions of 25° C., use of a standard cone rotor (1°34'×R24), a sample liquid volume of 1.2 mL, a rotation speed of 50 rpm, and three minutes.

The surface tension of the ink is preferably 35 mN/m or less and more preferably 32 mN/m or less at 25° C. from a viewpoint that the ink is suitably leveled on a printing medium to shorten the drying time of the ink.

The pH of the ink is preferably from 7 to 12, and more preferably from 8 to 11 from a viewpoint of preventing corrosion of a metal member in contact with a liquid.

Figure 2:
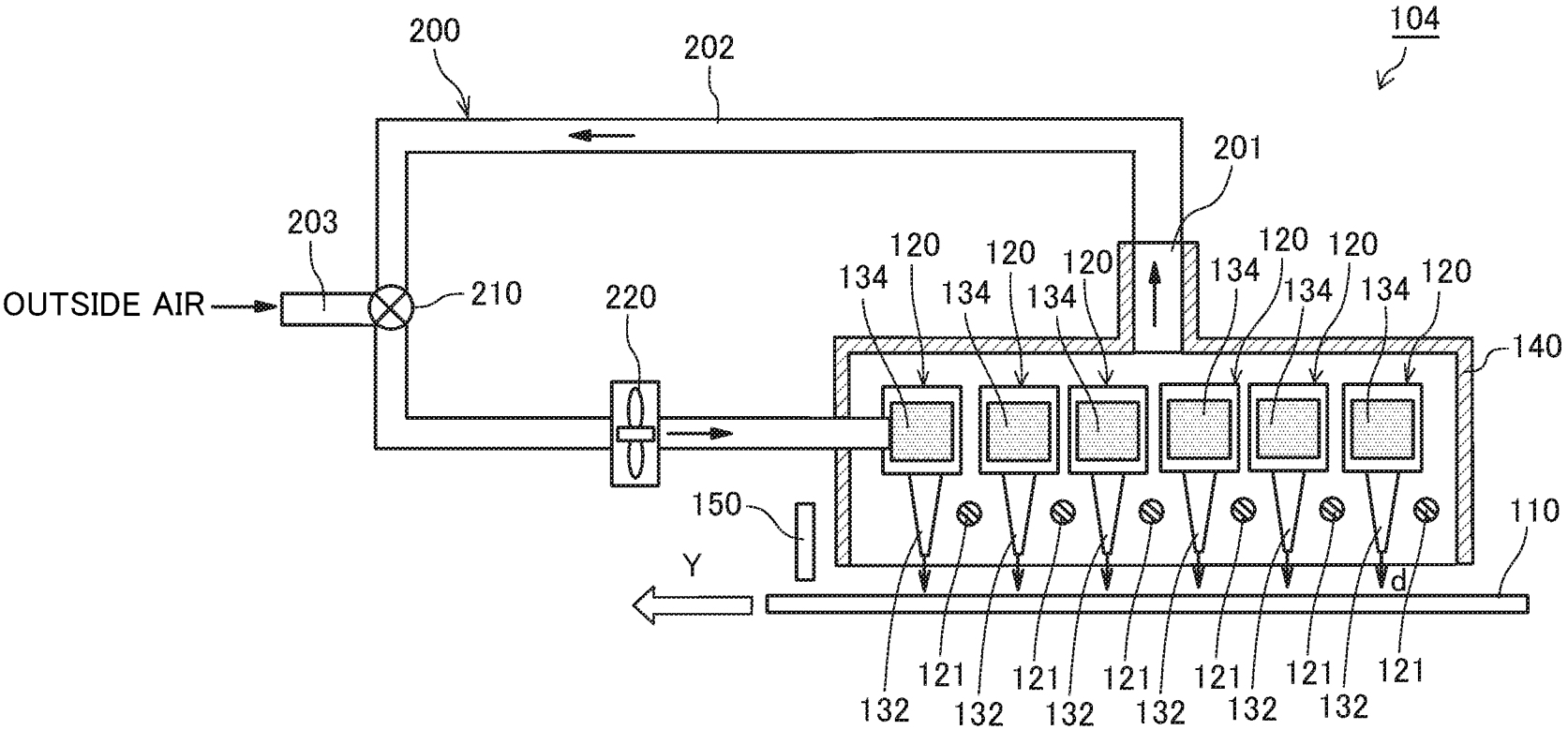
FIG. 2 is a schematic explanatory view of a drying device according to a first embodiment of the present disclosure.
Figure 3:
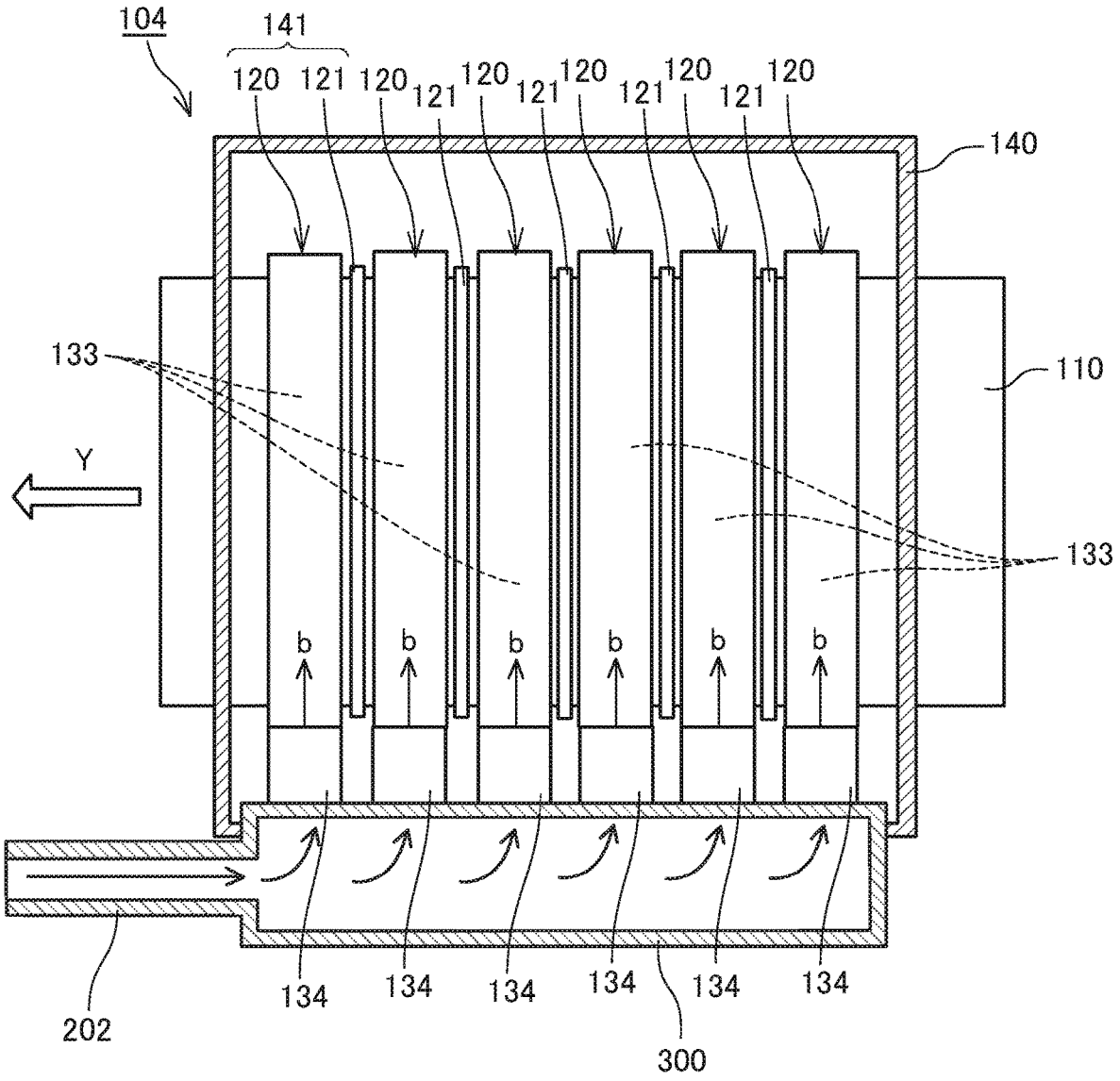
FIG. 3 is a plan explanatory view of the drying device.
Figure 4:
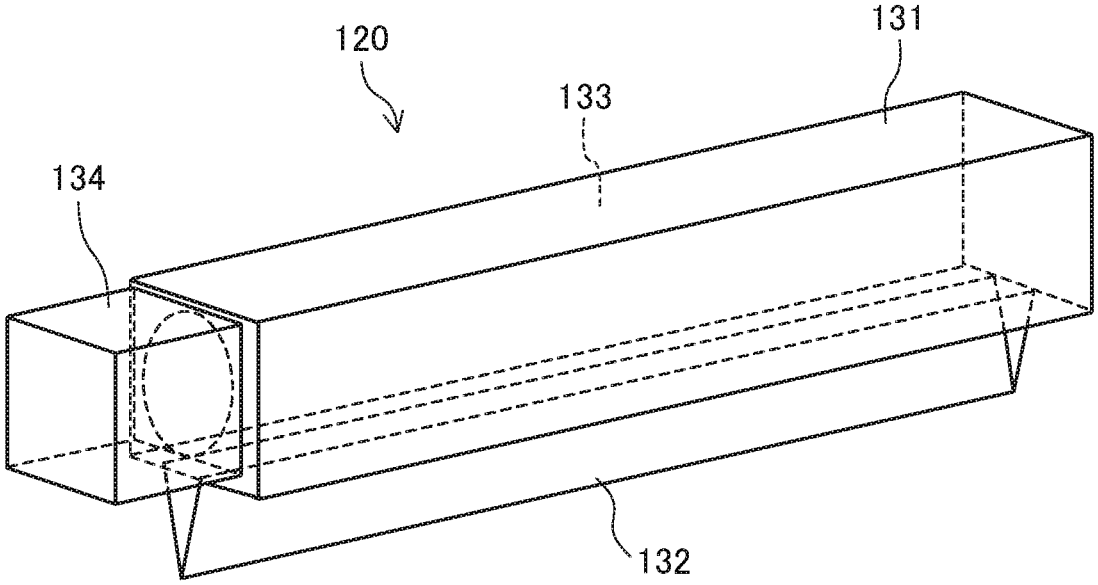
FIG. 4 is a perspective explanatory view of a blower of the drying device.

Next, a drying device according to the first embodiment will be described referring to FIGS. 2 to 4. FIG. 2 is a schematic explanatory view of the drying device, FIG. 3 is a plan explanatory view of the drying device, and FIG. 4 is a perspective explanatory view of a blower of the drying device.

The drying device 104 has a plurality of (here, six in total) air knives 120 as blowers arranged in a moving direction (the direction of the arrow Y: hereinafter referred to as "conveyance direction Y") of the continuous sheet 110 as a drying target object.

A radiation heater 121 which is a heater for air in the air knives 120 is disposed outside each of the air knives 120 and between adjacent air knives 120 and 120.

Each of the air knives 120 includes a long chamber (housing) 131 and a nozzle 132 which is a slit-shaped blowing port communicating with an interior 133 of the chamber 131. Note that the slit-shaped blowing port 132 may be one slit or a plurality of slits arranged in a width direction. The nozzle 132 has a length corresponding to a width in a direction intersecting with the conveyance direction Y.

Each of the air knives 120 of the present embodiment includes a fan 134 as an airflow generator for feeding a gas into the interior 133 of the chamber 131 at one end of the chamber 131 in a longitudinal direction. For example, by using a counter-rotating fan for the fan 134 as an airflow generator, a large air volume can be obtained.

Here, the air knife 120 is a first blower in which the fan 134 is disposed as an airflow generator on one end side in a direction intersecting with the moving direction (conveyance direction Y) of the continuous sheet 110.

An air flow in the direction of the arrow b is generated in the chamber 131 by the fan 134 of the air knife 120, and the air flow is jetted (blown out) from the nozzle 132 in the direction of the arrow d in FIG. 2.

The radiation heater 121 is disposed between adjacent air knives 120 and 120 in the conveyance direction Y. That is, the air knife 120 and the radiation heater 121 are alternately arranged.

As a result, air in two adjacent air knives 120 and 120 can be heated by one radiation heater 121. However, it is also possible to dispose the radiation heater 121 for every two air knives 120, for example.

The radiation heater 121 is preferably an infrared heater for emitting an infrared ray having a maximum wavelength in an absorption wavelength band of water contained in a liquid. A carbon heater using carbon as a material of a heating element is preferably used.

The air knife 120 and the radiation heater 121 constitute a drier 141 for drying a liquid composition (ink) on the continuous sheet 110 as a drying target object. A plurality of the driers 141 is surrounded by a device housing (housing) 140.

On a downstream side of the drying device 104, a temperature detector 150 for detecting the temperature of a surface of the continuous sheet 110 is disposed. As the temperature detector 150, a non-contact type temperature detector is preferable, and for example, an infrared type surface thermometer is preferable.

Outside the device housing 140, a gas circulator 200 for circulating a gas containing a volatile component of an organic solvent warmed and volatilized by the drier 141 and reusing the gas for drying is disposed.

The gas circulator 200 includes a circulation path 202 including an exhaust port 201 serving as a circulation path inlet for discharging a gas containing vapor in the drying device disposed in the device housing 140, a distribution path 300 for distributing the circulation path 202 to the plurality of air knives 120 of the drier 141 to recirculate the gas, and a circulation blower 220.

The gas circulator 200 further includes an outside air introduction path 203 for introducing outside air into the circulation path 202 of the gas circulator 200 and includes a circulation ratio adjuster 210 for mixing outside air with a gas in the circulation path 202 in the gas circulator 200 to adjust the concentration of a volatile component of an organic solvent, serving as a concentration adjuster Next, an outline of operation of the drying device 104 will be described.

The continuous sheet 110 to which a liquid has been applied by the liquid application device 101 is conveyed in the conveyance direction Y and passes through the drying device 104.

In the drying device 104, by energization of the radiation heater 121, radiant heat radiated from the radiation heater 121 is directly applied to the continuous sheet 110 being conveyed, and the continuous sheet 110 is heated by the radiant heat.

Air in the interior 133 of the chamber 131 of the air knife 120 is heated by the radiant heat of the radiation heater 121. Then, the fan 134 is driven to suck air. As a result, heated air (warm air) is blown out in the direction of the arrow d from the nozzle 132 and blown onto the continuous sheet 110 being conveyed.

The continuous sheet 110 is conveyed to a downstream side, and then the surface temperature of the continuous sheet 110 is detected by the temperature detector 150. At this time, electric power supplied to the radiation heater 121 is controlled such that the surface temperature of the continuous sheet 110 becomes a predetermined value.

With the above operation, a liquid on the continuous sheet 110 is heated to raise the vapor pressure of the liquid (ink), and the continuous sheet 110 and the liquid are dried.

A gas containing a volatile component of an organic solvent, generated by heating and evaporating the liquid on the continuous sheet 110, is discharged from the exhaust port 201 disposed in the drying device 104 into the circulation path 202 by the circulation blower 220.

The air containing vapor, discharged into the circulation path 202, passes through the circulation path 202 and is recirculated to an upstream side of the fan 134 of the air knife 120 again. As a result, the air is sucked by the fan 134 to be introduced into the interior 133 of the air knife 120.

The gas introduced into the air knife 120 has a higher temperature than the outside air. Therefore, the temperature rises to the temperature of air required for drying the ink to reduce the amount of power consumption to be supplied to the radiation heater 121.

The gas having a high concentration of vapor of an organic solvent, flowing through the circulation path 202, is mixed with outside air via the circulation ratio adjuster 210 having the outside air introduction path 203 to lower the concentration of vapor.

In this manner, the gas having a lower concentration of vapor is recirculated into the drying device 104 to suppress an increase in concentration of vapor of an organic solvent in the device housing 140 of the drying device 104. As a result, it is possible to improve explosion-proof safety while suppressing deterioration of a drying property of a liquid.

Here, the "circulation ratio" to be adjusted by the circulation ratio adjuster 210 is represented by Vex/(Vex+Ve) if a flow rate discharged from the exhaust port 201 of the drying device 104 is represented by Vex and a flow rate of air introduced from outside air is represented by Ve).

Figure 5:
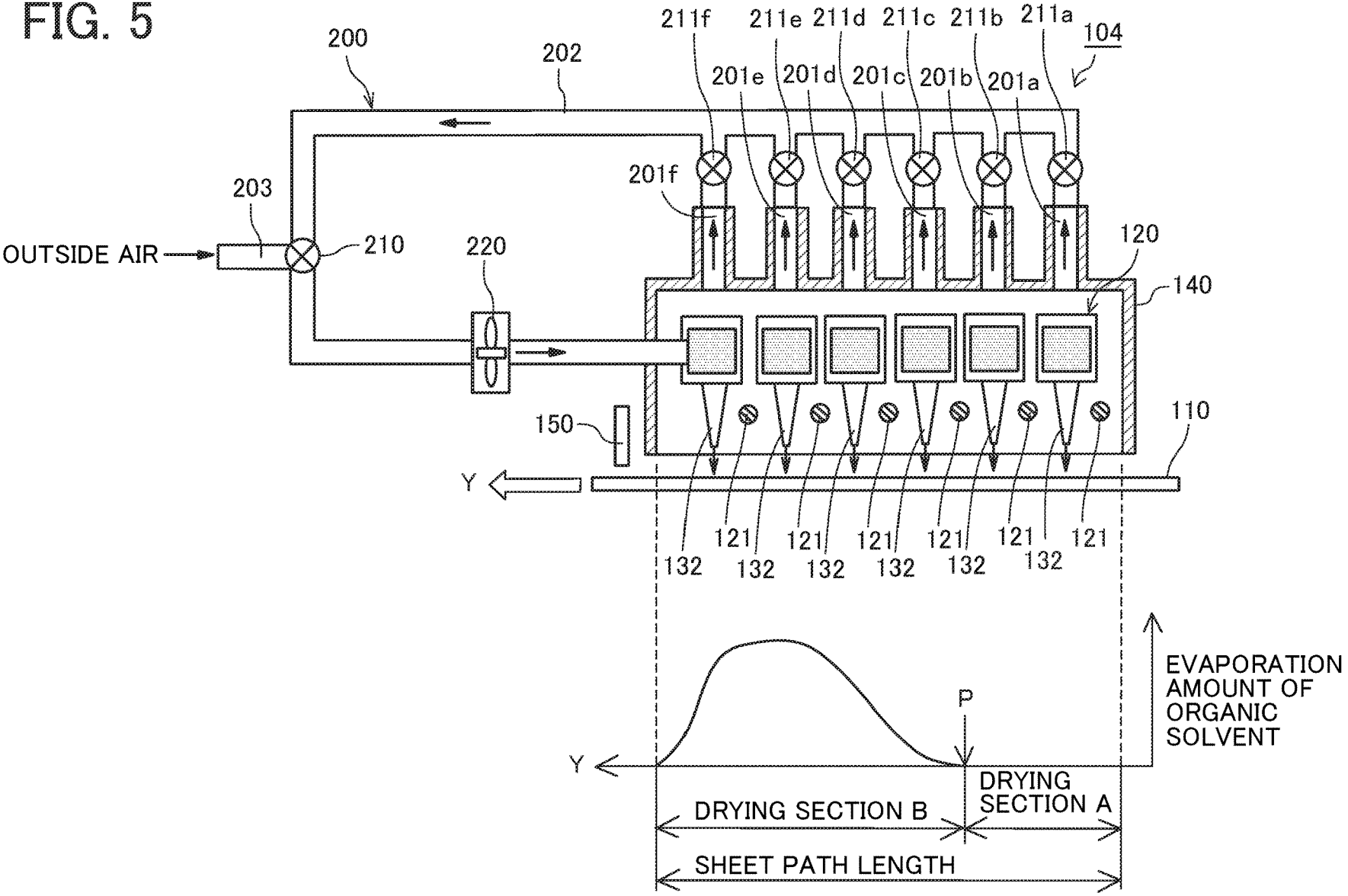
FIG. 5 is a schematic explanatory view of a drying device according to a second embodiment of the present disclosure.

Next, a second embodiment of the present disclosure will be described referring to FIG. 5. FIG. 5 illustrates a schematic explanatory view of a drying device according to the second embodiment and an explanatory diagram illustrating the amount of vapor of an organic solvent generated by heating a liquid in a conveyance direction Y.

In the present embodiment, a plurality of exhaust ports 201 is arranged in the conveyance direction Y of a continuous sheet 110. Here, the exhaust ports 201 are arranged above air knives 120.

As described above, as an organic solvent contained in an ink, a solvent having a vapor pressure lower than water is used from viewpoints of a drying property and discharge reliability of a nozzle of a liquid discharge head 111. Therefore, on a conveyance upstream side, there is a drying section A in which water evaporates but an organic solvent hardly evaporates, and evaporation of the organic solvent starts from a position P at which evaporation of water has almost finished.

Therefore, the concentration of vapor of the organic solvent generated in the drying section A is low, and the concentration of vapor of the organic solvent generated in the drying section B after the position P is high.

Therefore, in the present embodiment, the plurality of exhaust ports 201 (201*a* to 2010 and flow rate adjusters 211 (211*a* to 2110 connected to the exhaust ports 201 (201*a* to 2010 are arranged in a direction along the conveyance direction Y of the continuous sheet 110.

The opening amount of each of the flow rate adjusters 211*a* to 211*c* on a conveyance direction upstream side corresponding to the position of the drying section A in which the concentration of vapor of the organic solvent is low is set to be small, and the opening amount of each of the flow rate adjusters 211*d* to 211*f* on a conveyance direction downstream side corresponding to the position of the drying section B in which the concentration of vapor of the organic solvent is high is set to be large.

As a result, among the plurality of circulation path inlets (exhaust ports 201*a* to 2010 arranged in a conveyance direction of a drying target object, the flow rate of a gas flowing from one of the circulation path inlets (exhaust ports 201*d* to 2010 located on a downstream side in the conveyance direction is larger than the flow rate of a gas flowing from one of the circulation path inlets (exhaust ports 201*a* to 201*c*) located on an upstream side.

With such a configuration, it is possible to increase the inflow amount of a gas (exhaust amount) flowing from the drying section B in which the concentration of vapor of the organic solvent is high, and to effectively lower the concentration of vapor in the drying device 104. Therefore, explosion-proof safety can be further improved.

In this case, the opening amount (inflow amount) of the flow rate adjuster 211 can be determined according to at least any one of the type of a printing medium as a drying target object, the size thereof, the number of printed media, printing time, a printing speed, the kind of a liquid composition, and the discharge amount of the liquid composition.

Figure 6:
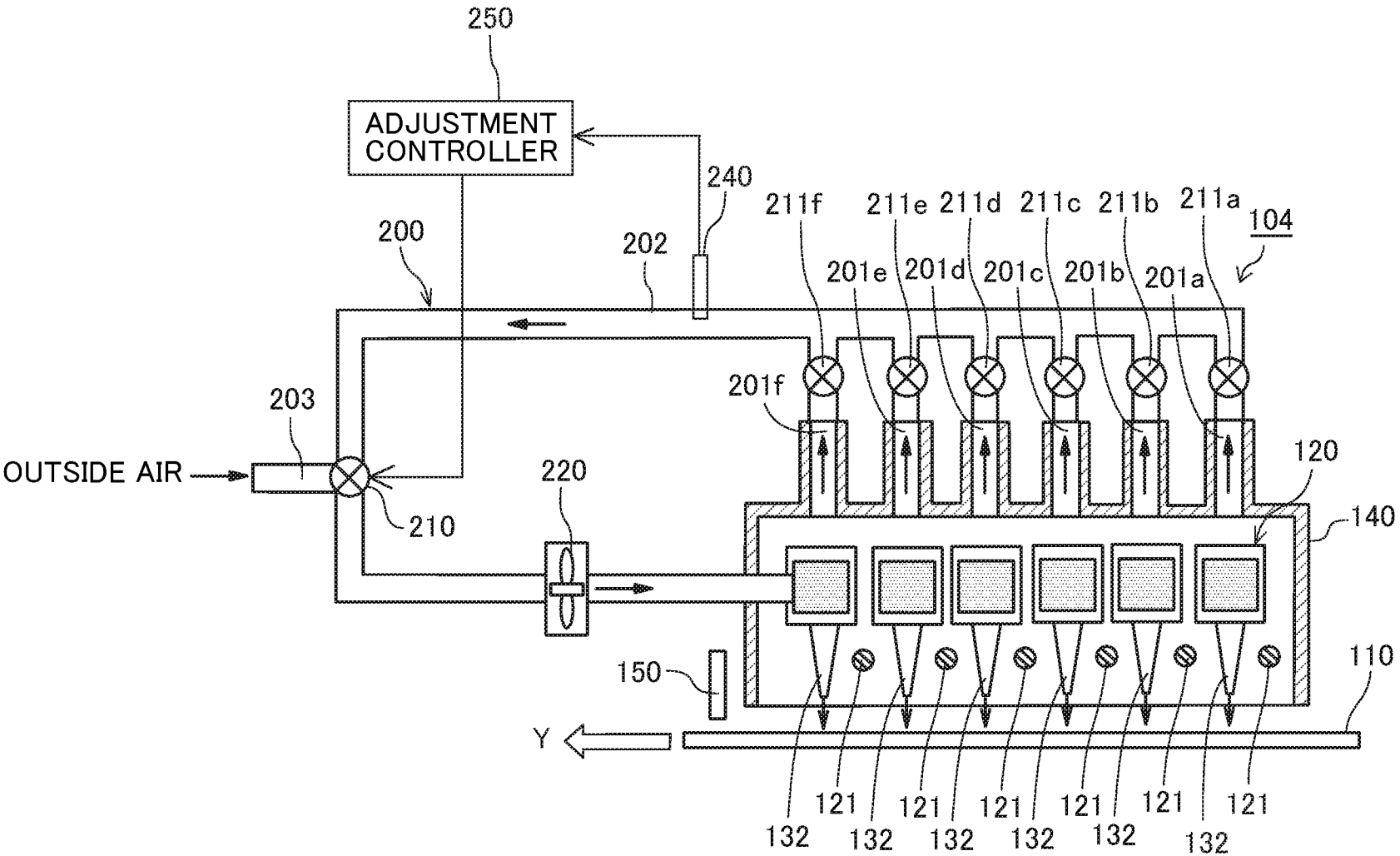
FIG. 6 is a schematic explanatory view of a drying device according to a third embodiment of the present disclosure.

Next, a third embodiment of the present disclosure will be described referring to FIG. 6. FIG. 6 is a schematic explanatory view of a drying device according to the third embodiment.

In the present embodiment, a gas detector 240 as the concentration detector for detecting the concentration of an organic solvent in a circulation path 202 in the second embodiment is included.

When the concentration of vapor (detection result) of a gas flowing in the circulation path 202, detected by the gas detector 240, is equal to or less than a predetermined concentration, an adjustment controller 250 controls a circulation amount adjuster 210 to reduce the introduction amount of outside air to increase a circulation ratio. As a result, the discharged gas is refluxed while the temperature thereof is high, and the amount of power consumption can be reduced.

Meanwhile, when the concentration of vapor of a gas flowing in the circulation path 202, detected by the gas detector 240, is more than the predetermined concentration, the circulation amount adjuster 210 is controlled to increase the introduction amount of outside air to lower a circulation ratio. As a result, explosion-proof safety can be secured.

Incidentally, in each of the above-described embodiments, an example in which the air knives as blowers are arranged in a direction orthogonal to the conveyance direction Y has been described. However, the air knives as blowers may be arranged in a direction intersecting with the conveyance direction Y at an angle other than a right angle.

In the above-described embodiments, the gas flown to be mixed may be any gas outside the gas circulator 200, for example, gas containing a low concentration of solvent in the drying device 10. In a case where mixing with the solvent and exhausting gas are simultaneously performed to adjust the concentration, the mixing is preferably performed using the gas from the outside of the drying apparatus 104 or the gas from the outside of the printing apparatus 100.

Figure 7:
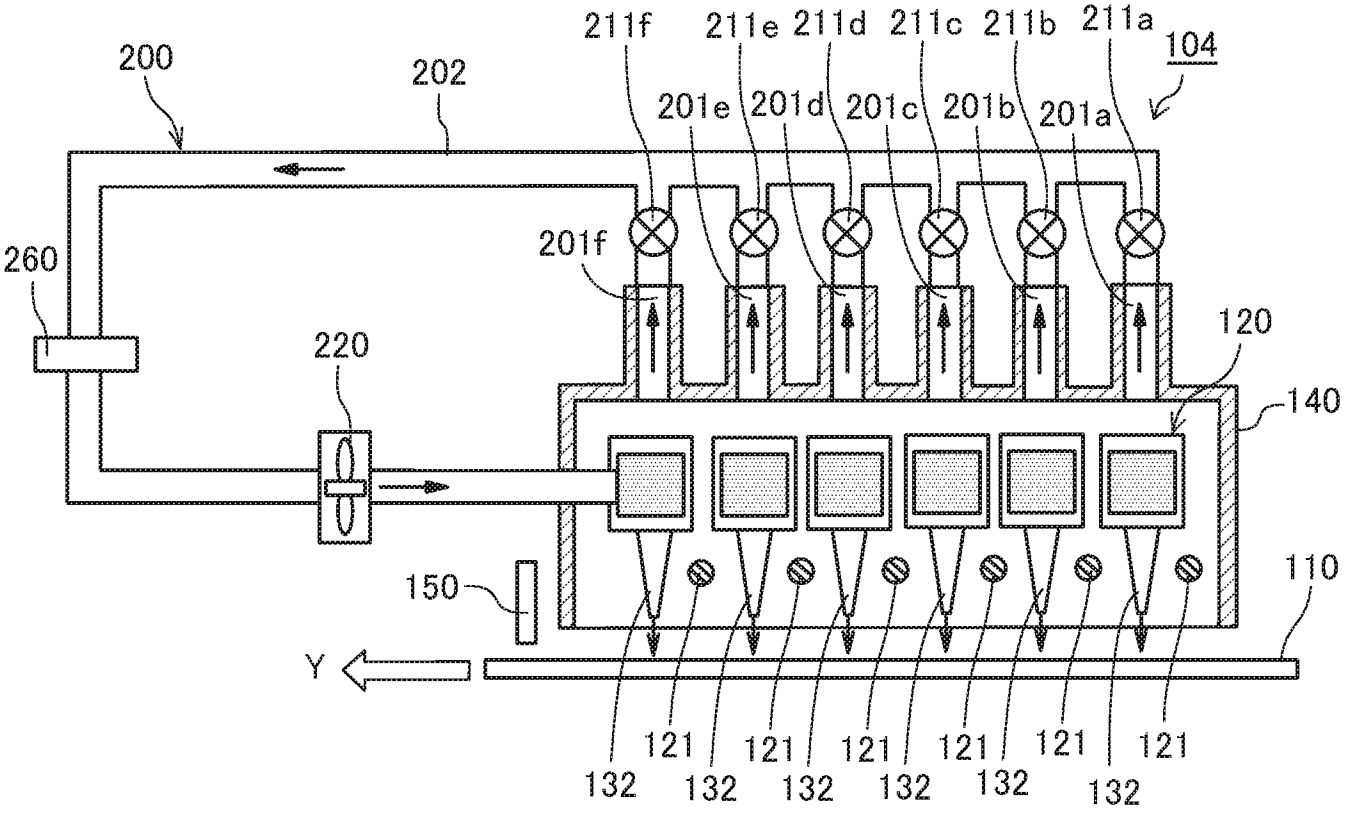
FIG. 7 is a schematic explanatory view of a drying device according to a fourth embodiment of the present disclosure.

Next, a fourth embodiment of the present disclosure is described with reference to FIG. 7. FIG. 7 is a schematic explanatory view of a drying device according to the fourth embodiment.

In the present embodiment, a filter 260 capable of blocking or absorbing the organic solvent is provided as a concentration adjuster in the circulation path 202. The organic solvent is blocked or absorbed by the filter 260 so that the concentration of the organic solvent is adjusted.

By providing the filter 260 capable of blocking or absorbing the organic solvent in this manner, the filter 260 can also serve as a filter to reduce the amount of solvent released into the outside air, thus simplifying the configuration of the drying device.

Figure 8:
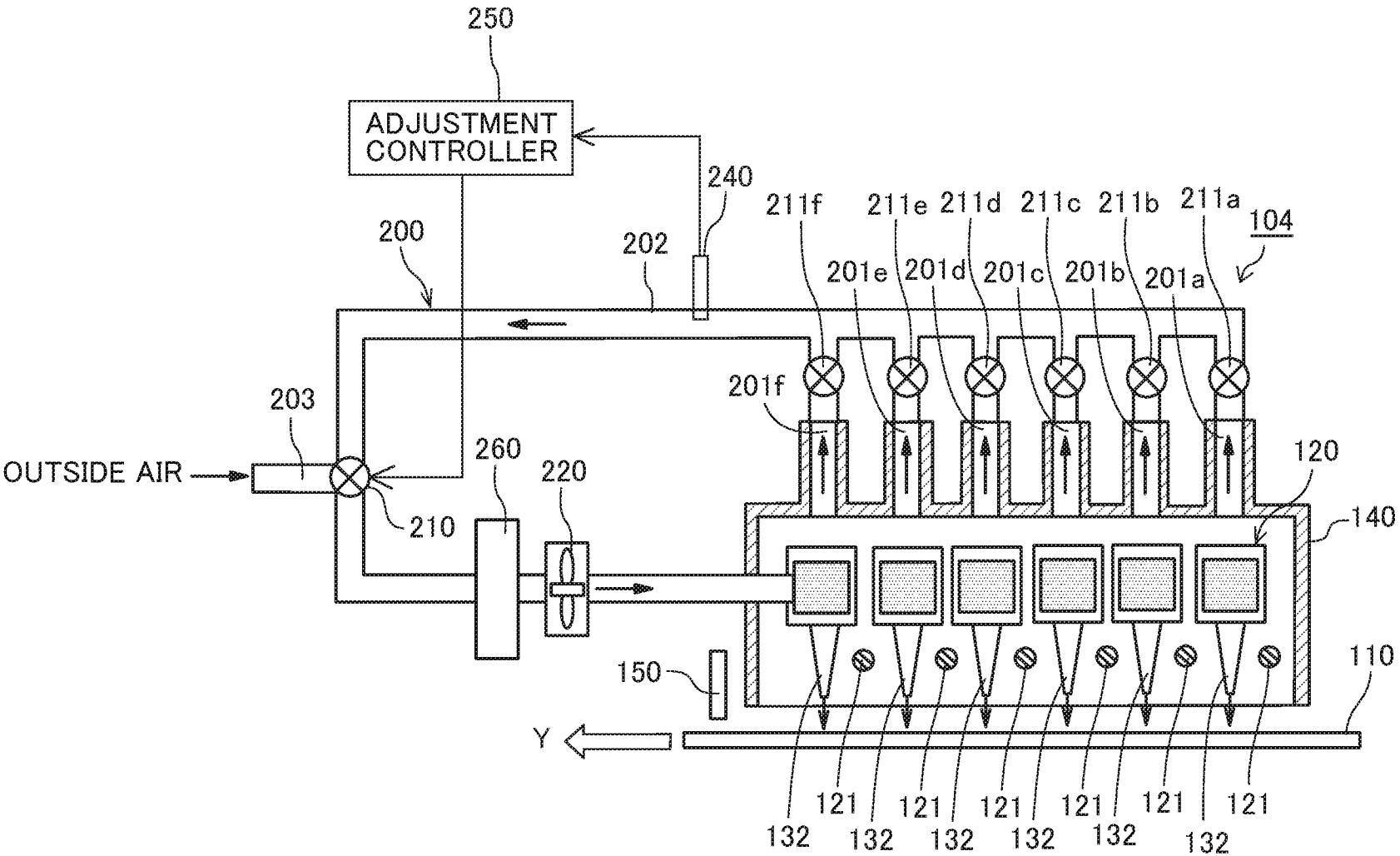
FIG. 8 is a schematic explanatory view of a drying device according to a fifth embodiment of the present disclosure The accompanying drawings are intended to depict embodiments of the present disclosure and should not be interpreted to limit the scope thereof. The accompanying drawings are not to be considered as drawn to scale unless explicitly noted.

Next, a fifth embodiment of the present disclosure is described with reference to FIG. 8. FIG. 8 is a schematic explanatory view of a drying device according to the fifth embodiment.

For the present embodiment, the filter 260 capable of blocking or absorbing the organic solvent is provided between the circulation ratio adjuster 210 and the circulation blower 220 in the third embodiment.

As described above, by using the gas outside the gas circulator 200 and the filter 260 together, the frequency of replacement of the filter 260 can be reduced. In addition, a certain amount of organic solvent can be evacuated to prevent a high concentration of organic solvent from staying for a long time.

In each of the above-described embodiments, the example in which the member to be conveyed is a continuous sheet has been described, but embodiments of the present disclosure are not limited thereto. Examples of the member include a continuous body such as a continuous sheet, roll paper, or a web, a recording medium such as a long sheet material, wall paper, and a printing material such as an electronic circuit board sheet such as a prepreg.

In addition to recording an image such as a letter or a figure with a liquid such as an ink, an image having no meaning, such as a pattern, may be applied to a drying target object with a liquid such as an ink for the purpose of decoration or the like.

In the present application, a liquid to be applied is not particularly limited. However, the liquid preferably has viscosity of 30 mPa·s or less at ordinary temperature and ordinary pressure or by heating and cooling. More specific examples of the liquid include a solution, a suspension, and an emulsion containing a solvent such as water or an organic solvent, a colorant such as a dye or a pigment, a functionalizing material such as a polymerizable compound, a resin, or a surfactant, a biocompatible material such as deoxyribonucleic acid (DNA), an amino acid, a protein, or calcium, or an edible material such as a natural dye. These liquids can be used, for example, for an inkjet ink, a surface treatment-liquid, a liquid for forming a constituent element of an electronic element or a light-emitting element or an electronic circuit resist pattern, or a three-dimensional modeling material liquid.

When a liquid discharge head is used as a liquid applicator, examples of an energy generating source for discharging a liquid include those using a piezoelectric actuator (laminated piezoelectric element and thin film piezoelectric element), a thermal actuator using an electrothermal transducer such as a heat generating resistor, and an electrostatic actuator including a diaphragm and a counter electrode.

Incidentally, in printing in the present application, image formation, recording, letter printing, photograph printing, and the like are all synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A drying device comprising:

a drier to warm a liquid composition on a drying target object, the drier comprising:

a housing;

a plurality of air knives as blowers arranged within the housing in a conveyance direction of the drying target object; and at least one radiation heater disposed within the housing between adjacent air knives;

a gas circulator coupled to the housing to circulate a gas containing a volatile component of an organic solvent warmed and volatilized by the drier to reuse the gas for drying; and a concentration adjuster to adjust a concentration of the volatile component reused.

2. The drying device according to claim 1, wherein:

the concentration adjuster mixes an internal gas of the gas circulator with an external gas of the gas circulator to adjust the concentration of the volatile component of the organic solvent.

3. The drying device according to claim 1, wherein:

the concentration adjuster includes a filter to block or absorb the organic solvent, and the concentration adjuster adjusts the concentration of the volatile component with the filter so that the concentration of the volatile component decreases.

4. The drying device according to claim 1, wherein:

the drier further comprises:

a plurality of exhaust ports in the housing arranged in the conveyance direction of the drying target object and coupled to the gas circulator; and the gas circulator further comprises:

a plurality of flow rate adjusters, each coupled to one of the exhaust ports and configured to selectively adjust a flow rate of the gas flowing through a corresponding exhaust port, wherein the flow rate of the gas flowing from one of the exhaust ports located on a downstream side in the conveyance direction is larger than the flow rate of the gas flowing from another of the exhaust ports located on an upstream side in the conveyance direction.

5. The drying device according to claim 1, wherein:

a circulation ratio of the gas by the gas circulator is determined according to a type of a printing medium of the drying target object.

6. The drying device according to claim 1, further comprising:

a concentration detector to detect a concentration of the organic solvent, wherein the concentration adjuster determines a circulation ratio according to a detection result of the concentration of the organic solvent.

7. A liquid discharge apparatus comprising:

the drying device according to claim 1; and a liquid applicator to apply the liquid composition to the drying target object.

8. The drying device according to claim 1, wherein:

a circulation ratio of the gas by the gas circulator is determined according to a size of a printing medium as the drying target object.

9. The drying device according to claim 1, wherein:

a circulation ratio of the gas by the gas circulator is determined according to a number of a printing medium as the drying target object.

10. The drying device according to claim 1, wherein:

a circulation ratio of the gas by the gas circulator is determined according to a printing time of a printing medium as the drying target object.

11. The drying device according to claim 1, wherein:

a circulation ratio of the gas by the gas circulator is determined according to a printing speed of a printing medium as the drying target object.

12. The drying device according to claim 1, wherein:

a circulation ratio of the gas by the gas circulator is determined according to a kind of the liquid composition.

13. The drying device according to claim 1, wherein:

a circulation ratio of the gas by the gas circulator is determined according to a discharge amount of the liquid composition.

14. The drying device according to claim 1, wherein each of the air knives comprises:

an elongated chamber;

a nozzle comprising a slit-shaped blowing port communicating with an interior of the elongated chamber; and a fan as an airflow generator for feeding the gas into the interior of the elongated chamber, wherein the fan is at one end of the elongated chamber in a longitudinal direction.

15. The drying device according to claim 1, wherein:

the drying target object comprises a continuous sheet of paper.

16. A drying method comprising:

warming a liquid composition on a drying target object by a drier, the drier comprising a housing, a plurality of air knives as blowers arranged within the housing in a conveyance direction of the drying target object, and at least one radiation heater disposed within the housing between adjacent air knives;

circulating, by a gas circulator coupled to the housing, a gas containing a volatile component of an organic solvent volatilized by the warming to reuse the gas for drying; and adjusting, by a concentration adjuster, a concentration of the volatile component reused.

* * * * *